United States Patent [19]

Armstrong et al.

[11] 4,201,597

[45] May 6, 1980

[54] NO DIG SEEPAGE PIT CLEANER

[76] Inventors: James A. Armstrong, c/o George Spector 3615 Woolworth Bldg., 233 Broadway; George Spector, 3615 Woolworth Building, 233 Broadway, both of New York, N.Y. 10007

[21] Appl. No.: 698,075

[22] Filed: Jun. 21, 1976

[51] Int. Cl.[2] ..... B08B 3/02; B08B 9/08

[52] U.S. Cl. ..... 134/167 R; 134/113; 15/246.5; 210/532 S

[58] Field of Search ..... 210/532 S; 15/246.5; 134/113, 166 R, 166 C, 167 R, 167 C, 168 R, 168 C, 22 R, 22 C, 169 R, 169 C, 172, 180–181, 198

[56] References Cited

U.S. PATENT DOCUMENTS

| | | | |
|---|---|---|---|
| 1,080,704 | 12/1913 | Lilleberg | 134/172 |
| 2,332,940 | 10/1943 | Senke | 134/167 R |
| 2,858,836 | 11/1958 | Geh et al. | 134/181 X |
| 2,896,643 | 7/1959 | Ottoson | 134/113 X |
| 3,183,940 | 5/1965 | Alquist et al. | 15/246.5 X |
| 3,202,285 | 8/1965 | Williams | 210/532 S X |
| 3,895,756 | 7/1975 | Jaeger | 134/181 X |

FOREIGN PATENT DOCUMENTS

| | | | |
|---|---|---|---|
| 110858 | 5/1964 | Czechoslovakia | 134/113 |
| 742844 | 1/1956 | United Kingdom | 134/167 R |

*Primary Examiner*—Robert L. Bleutge

[57] ABSTRACT

An apparatus which eliminates the need of digging so to expose a house sewage seepage pit in order that it may be periodically cleaned out; the apparatus consisting of equipment that can be lowered down the house sewer line and into the septic tank from where it protrudes through the outflow port into the seepage pit; the equipment including scanning equipment at the end of an extendable water pressure hose used to flush out the pit, for aligning the equipment with the port so that the hose can be aligned with the port and inserted therethrough into the seepage pit.

1 Claim, 6 Drawing Figures

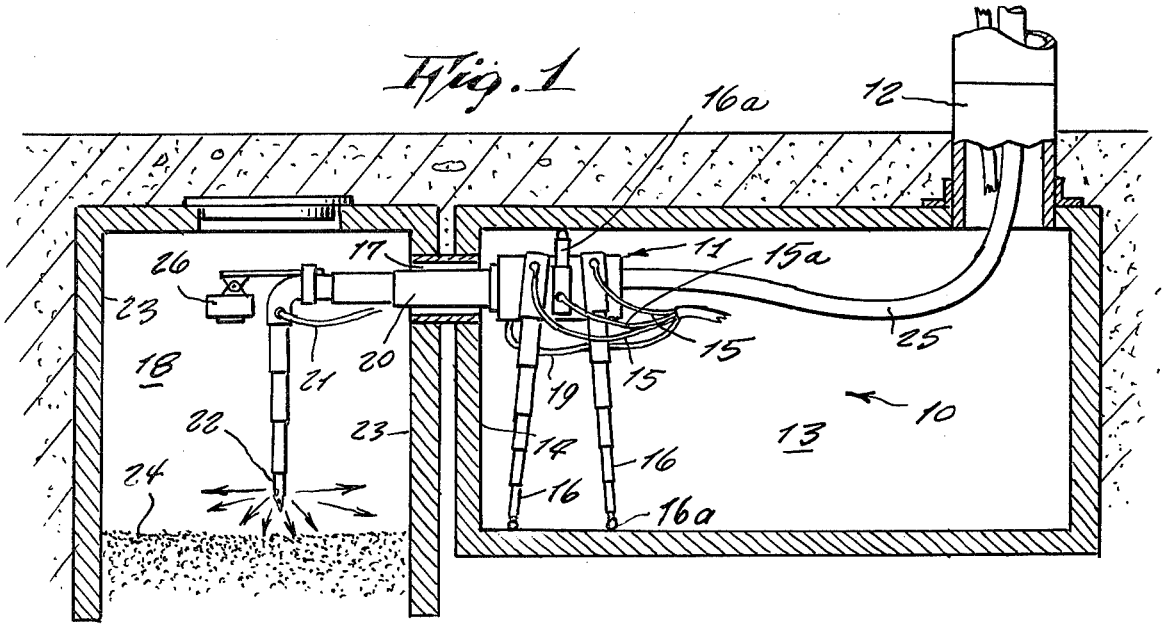
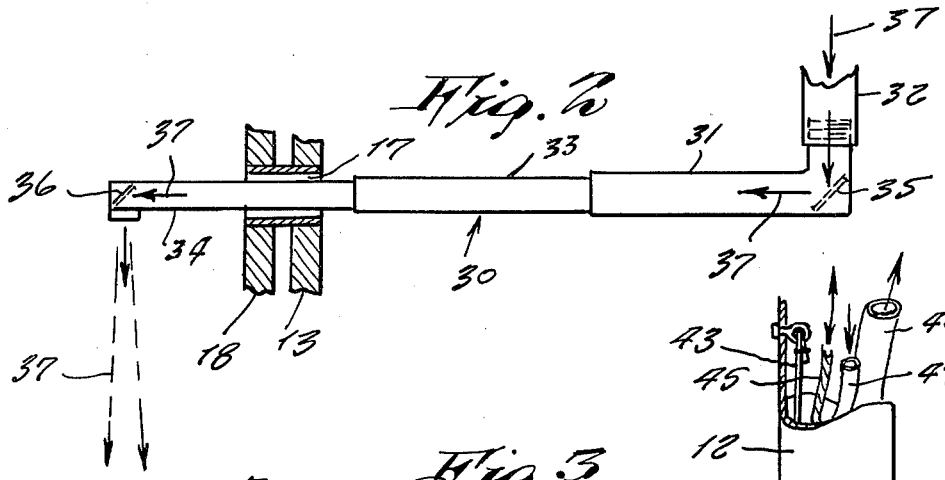
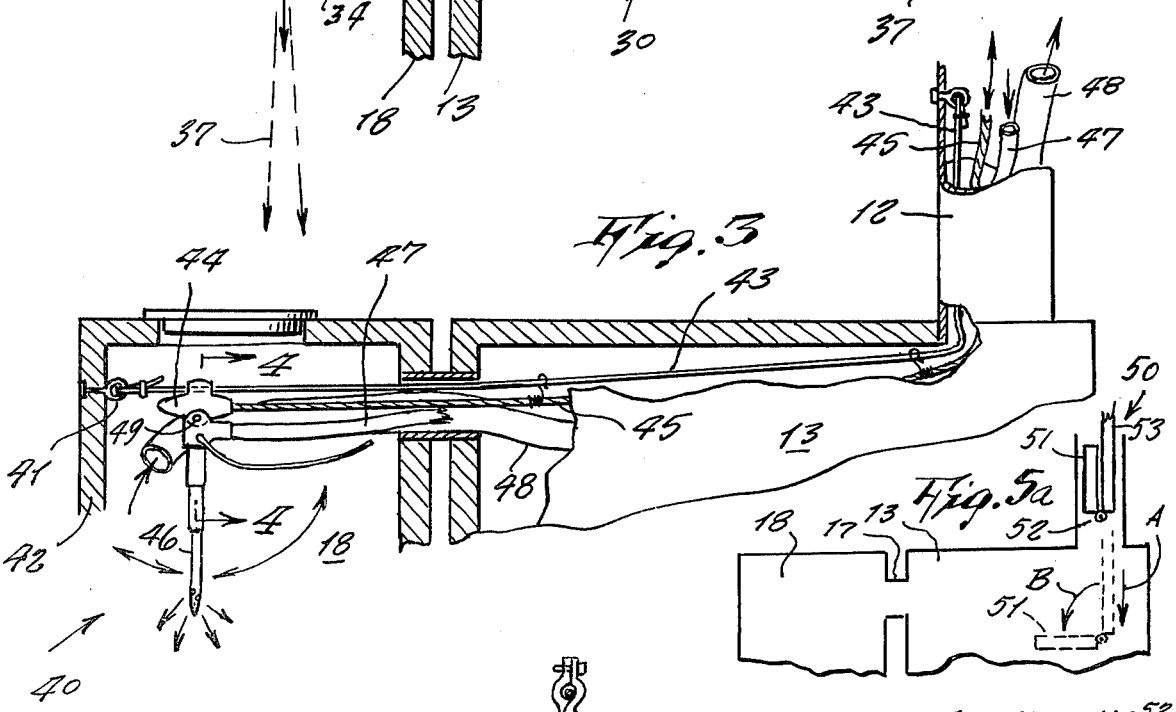
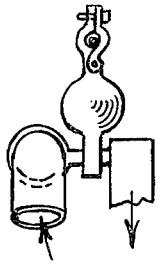
Fig. 4
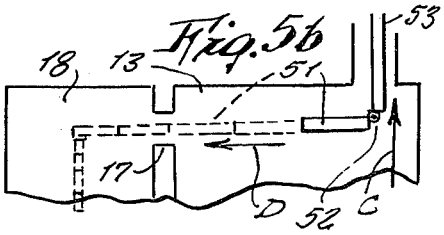

NO DIG SEEPAGE PIT CLEANER

This invention relates generally to cleaning apparatus for household sewer seepage pits.

It is generally well known to those skilled in the particular field that periodically the sewer seepage pit must be cleaned out so to remove an accumulation of grease therefrom. Heretofore, it has been necessary therefore to dig upon the ground above the seepage pit so to expose the manhole cover in order to gain access into the pit. This is a laborous task and destroys the lawn or other growing plants at the ground surface so that it is objectionable. Accordingly, this situation is in want of an improvement.

Therefore it is a principal object of the present invention to provide a cleaning device that can be lowered into a septic tank pit through the house sewer drain line wherein said device includes a hose line that can be directed into the seepage pit that accomplishes the same task and eliminates all the above described labor and reseeding or replanting of plants afterwards.

Another object is to provide a No Dig Seepage Pit Cleaner which saves time and which permits the operation to be done at any time of year, even winter when ground is frozen and digging work is not undertaken.

Other objects are to provide a No Dig Seepage Pit Cleaner which is simple in design, inexpensive to manufacture, rugged in construction, easy to use and efficient in operation.

These and other objects will be readily evident upon a study of the following specification and the accompanying drawing wherein:

FIG. 1 is a side cross sectional view of a seepage pit and septic tank of a house and showing the present invention installed therewithin.

FIG. 2 is a side view of a periscope structure for use instead of a TV camera used in the device of FIG. 1.

FIG. 3 is a side view of a modified design of the invention, and which includes a permanent installation installed when the septic tank and seepage pit are constructed.

FIG. 4 is a view in direction 4–4 of FIG. 3.

FIGS. 5*a* and 5*b* show successive steps of a further modified design for existing systems shown in side views.

Referring now to the drawing in greater detail, and more particularly to FIG. 1 at the present time, the reference numeral 10 represents a No Dig Seepage Pit Cleaner according to the present invention wherein there is a unit 11 that can be lowered down a sewer drain line 12 into a septic tank 13, and maneuvered inside the tank so to be brought adjacent the tank wall 14 after which hydraulic lines 15 extending outwardly through the drain line 12 are used to telescopically extend downwardly legs 16 so to align the unit with an outflow port 17 that communicates with a seepage pit 18. Upward telescopic leg 16*a* controled by hydraulic line 15*a* braces the unit against the tank ceiling. Another hydraulic line 19, extending also outwardly through the drain line 11, then is used to telescopically extend an arm or boom 20 through the port 17 and into the pit 18, after which another hydraulic line 21 provides pressure for telescopically lowering a nozzle 22 through which water under high pressure is then directed against the side walls 23 of the pit and also against the sand 24 in the bottom of the pit so to flush the grease accumulation therefrom. Water under pressure is thus brought into the pit through hose 25, to unit 11, boom 20 and to the nozzle 22. It should be noted that the telescopic extensions referred to herein above are accomplished with conventional hydraulically operated apparatus, well known in the art and specific description thereof would be verbose.

In order that the work can be done efficiently and thoroughly, a small TV camera 26 is mounted at a forward end of the boom 20 so to allow viewing the work remotely and thus see when the pit is cleaned sufficiently. Moreover the television equipment is equipped with illuminating lights to align the boom 20 with port 17. Legs 16 are provided with rollers 16*a* to facillate alignment of the device.

In FIG. 2, there is illustrated a periscope 30 for use instead of the above described TV camera 26, and which of course will be considerably less expensive to purchase. It includes L-shaped angle section 31 screw threaded into section 32 which extends down through the drain line 12. By maneuvering the sections 31 and 32, the section 31 can be brought into a horizontal position in the septic tank as shown, after which arm sections 33 and 34 are telescopically extended so to pass through the port 17 into the pit 18. Mirrors 35 and 36 inside the periscope permit a line of sight as indicated by arrows 37 so a person can remotely observe the cleaning operation performing inside the pit. The periscope is provided with an electric light at the forward end of arm 34 to provide illumination. The periscope and boom 20 are of diameter to permit insertion together through the port 17.

In FIG. 3, a No Dig Seepage Pit Cleaner 40 is shown that is of permanent installation type and which accordingly is installed at the time that the pit and septic tank are placed into the ground. Accordingly, an eye bolt 41 is permanently affixed to a wall 42 of the pit, and one end of a rust proof wire 43 is affixed thereto.

This cleaner 40 includes the permanent wire 43 installed between an upper part of a drain line 12 and the far end of the pit, the wire extending through the connecting pipe port 17 between the septic tank and pit so that a shoe 44 can be removably attached to the wire at a time when the pit is intended to be cleaned out, the shoe being pushed along the wire by a metal conduit coil type snake 45 so to be pushed down from the drain line into the pit, the shoe carrying the spray nozzle mechanism attached to a hose and also carrying a larger diameter hose for pumping the loosened scum and water out of the pit; the hoses extending upwardly out of the drain line 12; this form of the invention being less expensive by needing none of the complex support structure shown in FIG. 1, and which is quicker and easier to set up each time because it eliminates hunting for the connecting port between the septic tank and pit; the shoe if preferred being able to also carry the TV camera or periscope if so wished, but which probably will not be needed as the shoe can be slided back and forth in the pit so the nozzle reaches all areas; this form of the invention also eliminating need to pump out the septic tank so to install the invention.

The nozzle mechanism 46 includes a hydraulically controlled telescopic section depending pivotally free on a pivot pin 49 of the shoe.

In FIGS. 5*a* and 5*b* another design of cleaner 50 is shown schematically and which includes a head section 51 pivotally attached by a hinge 52 to a long pipe 53 which are installed by being lowered through the drain line 12 as shown by solid lines in FIG. 5*a*, wherein the head section accordingly is carried folded against a side of the pipe. When it is sufficiently lowered below a lower end of the drain line, as shown at A, then the head section pivots downwardly into a horizontal position as shown at B. Thereafter the pipe is pulled upwardly as shown by solid lines and arrow C in FIG. 5*b* so that the horizontal head section aligns with the port 17. Thereafter by means of above described hydraulic lines (not shown) extending upwardly out of the drain line 12, the head section is made to telescopically extend as shown by dotted lines and arrow D in FIG. 5*b* so to extend through the port 17 and into the pit. Thus a hose end carried by the head is brought into the pit for flushing it out. It is also understood that a downwardly telescopic tip of the head may be included, as shown in FIG. 1, and operated in a same manner, so to direct a nozzle close to the sand at the bottom of the pit, as described in FIG. 1. Periscopic illuminated equipment or the television apparatus as described may be provided on the device of FIGS. 5*a* and 5*b* to align the sections with port 17.

While various detail changes may be made of this invention, it should be noted such changes are within the scope of this invention.

What is claimed is:

1. A seepage pit cleaner comprising a fluid conduit and a cleaning assembly, said entire assembly being insertable into a septic tank having a floor, ceiling and walls via a sewer drain line, said assembly including a first means to support itself movably and structurally independent relative the septic tank walls and ceiling including a horizontally telescopically extendable hollow boom in communication with said conduit said boom including a nozzle at a forward end thereof, said boom and nozzle being adapted for insertion and extension through a seepage pit drainage hole, including remote control means for extending said boom, wherein said assembly comprises a head hinged to the conduit and being pivotable from a folded vertical to an open horizontal position, said head being telescopically horizontally extendable and including a forward tip housing a vertically extendable fluid line provided with a nozzle.

* * * * *